US006204655B1

(12) United States Patent
Koo

(10) Patent No.: US 6,204,655 B1
(45) Date of Patent: Mar. 20, 2001

(54) VOLTAGE-CONTROLLED CURRENT SOURCE WITH VARIABLE SUPPLY CURRENT

(75) Inventor: Ronald B. Koo, Mountain View, CA (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 0 days.

(21) Appl. No.: 09/430,841

(22) Filed: Nov. 1, 1999

(51) Int. Cl.[7] ..... G05F 3/16
(52) U.S. Cl. ..... 323/316
(58) Field of Search ..... 323/315, 316, 323/317; 327/538; 330/296

(56) References Cited

U.S. PATENT DOCUMENTS 4,055,774 * 10/1977 Ahmed ..... 323/316
5,936,393 * 8/1999 Nauta ..... 323/316

OTHER PUBLICATIONS

Gilbert, *IEEE Journal of Solid–State Circuits*, SC–3(3):353–365 Sep. 1968.

Gilbert, *IEEE Journal of Solid–State Circuits*, SC–3(3):365–373 Sep. 1968.

* cited by examiner

*Primary Examiner*—Shawn Riley
(74) *Attorney, Agent, or Firm*—Fish & Richardson P.C.

(57) ABSTRACT

A method and apparatus for providing electrical output current. The method includes providing a supply current, providing a first and second voltage input signal for controlling output current and generating an output current based on a differential voltage measured between the first and second input voltage signals including increasing the supply current as the output current increase. The apparatus for providing electrical current includes biasing circuitry providing a biasing current $I_{CC}$ and input circuitry including a first and second voltage input. The input circuitry is operable to receive the biasing current $I_{CC}$ and to divide the biasing current $I_{CC}$ based on the differential voltage measured between the first and second voltage inputs producing first and second biasing currents. A pair of translinear circuits is included that are operable to receive the first and second biasing currents and responsive thereto produce a first and second output current. The first and second output currents are summed to produce a final output current for the device where the final output current is a minimum of $I_{CC}$ when the differential voltage is approximately zero volts.

31 Claims, 10 Drawing Sheets

VOLTAGE-CONTROLLED CURRENT SOURCE WITH VARIABLE SUPPLY CURRENT

The present invention relates generally to electrical circuits and, more particularly, to a voltage-controlled current source with a variable supply current.

BACKGROUND

In conventional electrical circuits, current sources are often essential to a circuit design. One especially useful form of a current source is a voltage-controlled current source, in which the output current is dependent upon an input differential voltage. Depending on the application, a current source may be required to support dramatically different loads. That is, the current source may be required to operate at a high current output level for one time period, then operate at a low current output level for another time period. Conventional voltage-controlled current sources that operate to source a wide range of current levels generally are designed to include a large standby current to support the large current output required during high output modes (cycles). In these applications, the large standby current must be maintained even if the output current is low. A high standby current may result in an inefficient use of power, and also may cause undesirable heating.

SUMMARY

In one aspect, the invention provides a method for providing electrical output current. The method includes providing a supply current, providing a first and second voltage input signal for controlling output current and generating an output current based on a differential voltage measured between the first and second input voltage signals including increasing the supply current as the output current increase.

In another aspect, the invention provides a device for providing electrical current and includes biasing circuitry providing a biasing current $I_{CC}$ and input circuitry including a first and second voltage input. The input circuitry is operable to receive the biasing current $I_{CC}$ and to divide the biasing current $I_{CC}$ based on the differential voltage measured between the first and second voltage inputs producing first and second biasing currents. A pair of translinear circuits is included that are operable to receive the first and second biasing currents and responsive thereto produce a first and second output current. The first and second output currents are summed to produce a final output current for the device where the final output current is a minimum of $I_{CC}$ when the differential voltage is approximately zero volts.

Aspects of the invention can include one or more of the following advantages. A current boost circuit is provided that can generate an output current that is based on the magnitude of a differential input voltage. The current boost circuit includes a supply current that increases as the output current increases. No standby high supply current is required when the output of the current boost circuit is low. The current boost circuit can be customized to increase or decrease gain characteristics of the device and limit current output for the device.

Other features and advantages of the invention will become apparent from the following description and from the claims.

DETAILED DESCRIPTION

Figure 1:
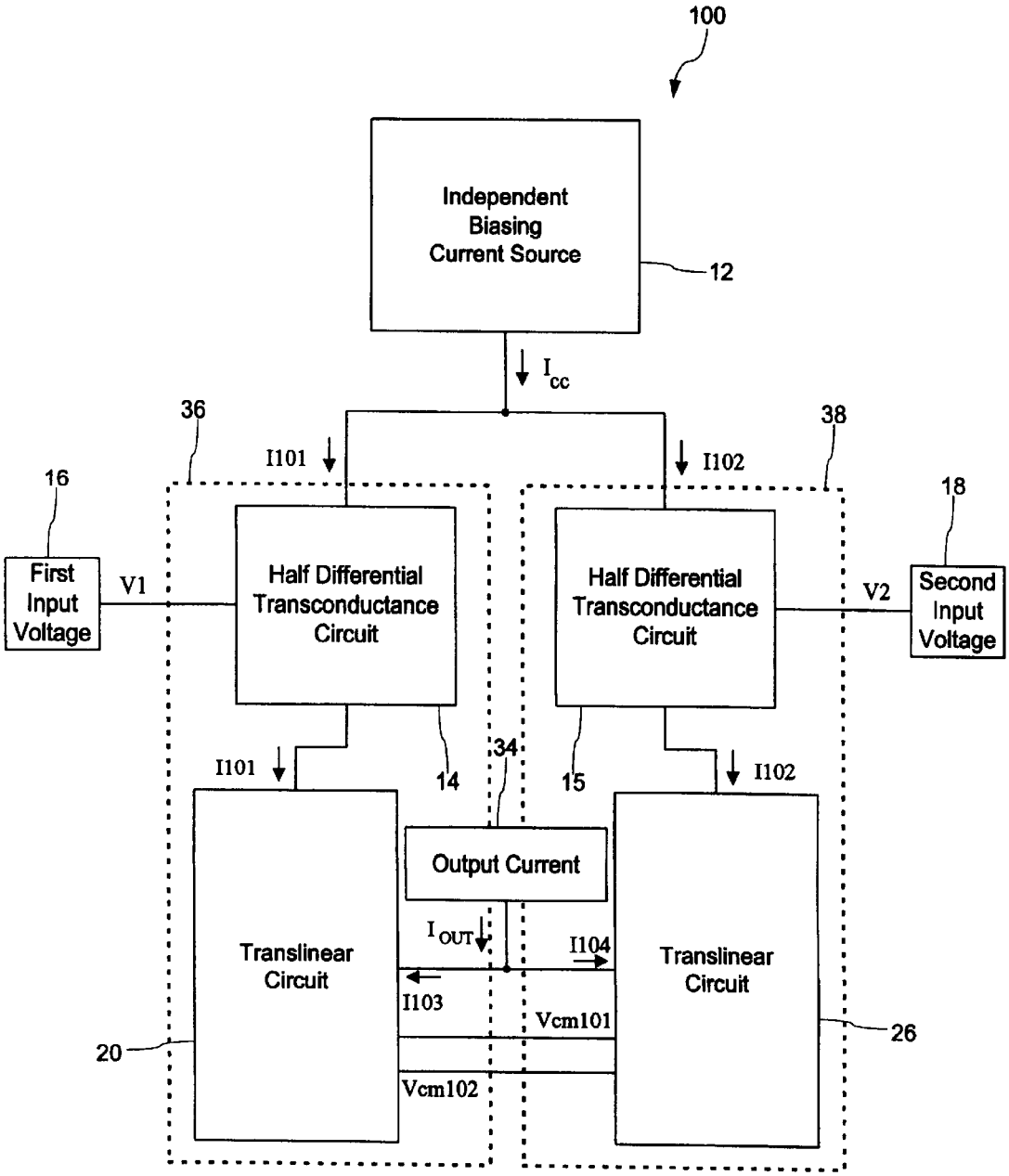
FIG. 1 is a block diagram for a voltage-controlled current source in accordance with the invention.

FIG. 1 is block diagram showing the principal elements of a current boost device 100. In one implementation current boost device 100 is mirror-symmetric, with a left half 36 and right half 38. In one implementation, current boost device is constructed with plural transistors and includes an independent biasing current source 12 that may be used to bias the transistors into a desired state. The biasing current source 12 provides a constant current with a value of $I_{CC}$ amperes. Circuits which may be used to create a biasing independent current source are well known to those skilled in the art. In one implementation, the transistors in current boost device 100 are bipolar junction transistors biased in the forward active state.

Current boost device 100 includes plural inputs including a first input voltage 16 (of value V1) and a second input voltage 18 (of value V2). Although the circuit's left half 36 and right half 38 may have identical hardware, they may operate differently by the application of varied input voltages. The first input voltage 16 is applied to the left half 36 and the second input voltage 18 is applied to the right half 38. The sources of the input voltages are not shown. The input voltages are applied to half differential transconductance circuits 14, 15, which together form a differential transconductance input pair.

If input voltages V1 and V2 are not equal to each other (a differential voltage $V_d$ is not equal to zero, where $V_d$=V1−V2) then the currents produced on each half of the circuit will not be equal. The current produced by the left half differential transconductance circuit 14 is designated I101 and the current produced by the right half differential transconductance circuit 15 is designated I102. On one side of the differential pair (either of the left or right half 36, 38), the bias current $I_{CC}/2$ plus some differential current $I_d$ flows; on the other side, $I_{CC}/2$ less the differential current $I_d$ flows.

Current from each half differential transconductance circuit 14, 15 flows into translinear circuits 20, 26, respectively. As will be shown below, each translinear circuit 20, 26 includes a current mirror, which requires that the translinear circuits share mirror voltages Vcm101 and Vcm102. Translinear circuits 20, 26 also include an output stage. Currents from the left and right output stages are designated I103 and 1104, respectively. Currents 1103 and 1104 combine according to Kirchhoff's current law to produce the output current 34, which has a value of $I_{OUT}$ amperes. The direction of current flow shown is merely for reference and does not necessarily indicate the direction of positive current flow.

Figure 2:
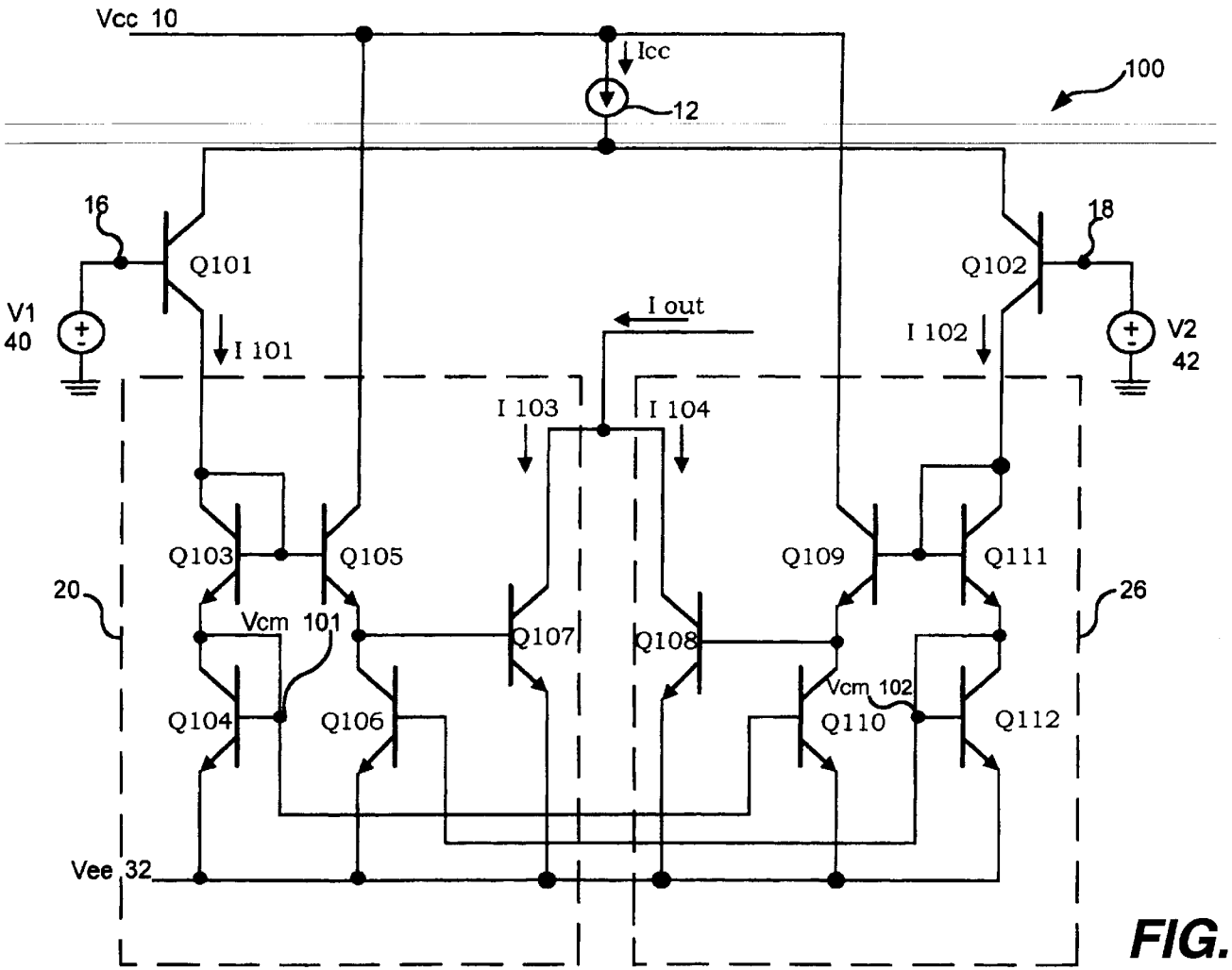
FIG. 2 is a schematic diagram of an electrical circuit for an alternative implementation of a voltage-controlled current source.

Referring now to FIG. 2, a circuit diagram for an implementation of current boost device 100 is shown. The circuitry for the current boost device resides between two power supplies, represented by voltages applied to nodes 10 and 32. The sources of the power are not explicitly shown. The first power supply 10 has a value of $V_{CC}$ volts and the second power supply 32 has a value of $V_{EE}$ volts. In one implementation, the voltage of the first power supply 10 is higher than that of the second power supply 32. Further, it is anticipated that the circuit will best function if $V_{CC}$ is at a higher potential than $V_{EE}$.

The current boost device 100 is mirror-symmetric. The differential transconductance circuits 14, 15 are represented as a differential pair of transistors QI01, Q102 respectively. Coupled to bases of Q101 and Q102 are independent voltage sources 40, 42, with values of V1, V2 respectively. In this implementation, translinear circuit 20 includes npn bipolar junction transistors Q103, Q104, Q105, Q106 and Q107, while translinear Circuit 26 includes npn bipolar junction transistors Q108, Q109, Q110, Q111 and Q112.

In the implementation shown, it is assumed that each transistor is near-ideal, i.e., with a very large amplification factor beta (β) and a negligible base current. A consequence of this assumption is that the each bipolar junction transistor's collector current is equal to its emitter current, and may be generally called the "current flowing through" the transistor. The current flowing through QI01 is identified as I101 and the current flowing through Q102 is identified as I102.

Focusing upon the left half of the current boost device 100, current I101 flows through QI01, to and through diode-connected transistor Q103 and diode-connected transistor Q104, and on to the second power supply 32. Transistors Q104 and Q110 are an emitter-coupled pair, forming a current mirror. The bases of Q104 and Q110 share a common voltage, Vcm101. Because the base-to-emitter voltage ($V_{BE}$) of Q104 is equal to the $V_{BE}$ Of Q110, the collector currents of these transistors, I101 and I101M, are equal in magnitude. The relation between collector current and base-to-emitter voltage is described in greater detail below. Consequently the amount of current I101 flowing through Q104 is mirrored to Q110, and flows through Q110, where it is designated I101M. The current flowing through Q110 is drawn through Q109. As a result, current I101M flows through Q109 and Q110, then to the second power supply 32.

By a similar analysis, current I102 flows through Q102, diode-connected transistor Q111 and diode-connected transistor Q112, then to the second power supply 32. Q112 and Q106 form a emitter-coupled current mirror, causing current I102M to flow through Q106. The current I102M is drawn through Q105. As a result, current I102M flows through Q105 and Q106, then to the second power supply 32.

In a bipolar junction transistor, the base-to-emitter voltage $V_{BE}$ is approximately related to the collector current Ic by the non-linear equation $$I_C = I_S \exp(V_{BE}/V_T)$$

where $I_S$ is the reverse saturation current (sometimes called the scale current) and $V_T$ is the thermal voltage. $V_T$ is dependent upon temperature. $I_S$ is dependent upon several factors, such as temperature, doping densities and transistor geometry. Increasing collector current will cause an increase in the base-to-emitter voltage, all other factors being constant, and vice-versa. In the same way, a decrease in collector current will lead to a decrease in the base-to-emitter voltage, all other factors being constant and vice-versa. In analysis of this circuit, it may be assumed that $I_S$ and $V_T$ are identical for all transistors.

If the left side input voltage 40 is less than the right side input voltage 42, then the magnitude of $V_{BE}$ Of Q101 will be greater than the magnitude of $V_{BE}$ of Q102, and as a consequence I101 will be greater than I102. I101 will be $I_{CC}/2$ plus some differential current $I_d$, and I102 will be $I_{CC}/2$ less some differential current $I_d$. In particular, $$\mathrm{I101} = I_{CC}/(1+\exp(V_d/V_T))$$

where $V_d$ is the differential voltage at the voltage inputs 16 and 18 (V1−V2). Similarly, $$\mathrm{I102} = I_{CC}/(1+\exp(-V_d/V_T))$$

The differential current $I_d$ is equal to (I101−I102)/2. The relationship between $V_d$ and $I_d$ is that of a hyperbolic tangent:

$$I_d = -(I_{CC}/2)\tan\mathrm{h}(V_d/V_T)$$

Looking at the left half of the device, and assuming I101 is greater than I102M, the base-to-emitter voltage drops of Q103 and Q104 will be greater than the base-to-emitter voltage drops of Q105 and Q106. The effect is that the emitter voltage of Q105 will be greater than the emitter voltage of Q103. Because the emitter voltage of Q105 is the same as the base voltage of Q107, it follows that the base-to-emitter voltage of Q107 will be greater than the individual base-to-emitter voltages of Q103, Q104, Q105, and Q106. Consequently the collector current flowing through Q107 will be greater than the currents flowing through Q103, Q104, Q105, and Q106, according to the non-linear equation given above.

Looking at the right half of the circuit, and again assuming I101 is greater than 1102, the base-to-emitter voltage drops of Q111 and Q112 will be less than the base-to-emitter voltage drops of Q109 and Q110. The effect is that the emitter voltage of Q109 will be less than the emitter voltage of Q111. Because the emitter voltage of Q109 is the same as the base voltage of Q108, it follows that the base-to-emitter voltage of Q108 will be less than the individual base-to-emitter voltages of Q109, Q110, Q111, and Q112. Consequently the collector current flowing through Q108 will be less than the currents flowing through Q109, Q110, Q111, and Q112, according to the non-linear equation given above.

By Kirchhoff's current law, the collector currents flowing through Q107 and Q108, I103 and 1104 respectively, add together to produce the output current $I_{OUT}$.

As previously noted, the mathematical relationship between base-to-emitter voltage and collector current is not a linear one. As a consequence, the higher base-to-emitter voltage of Q107 creates a higher collector current I103. The lower base-to-emitter voltage of Q108 creates a lower collector current 1104. Because of the nonlinear relationship, the increase in 1103 is far greater than the decrease in 1104:

$$I_{OUT}=I_{CC}(\cos h(3V_d/2V_T))/(\cos h(V_d/2V^T)).$$

As such, an output current is produced which varies according to the absolute value of the differential voltage. Because the hyperbolic cosine function is an even function, the relationship between the output current and the differential voltage is also an even function. For I101>>I102, the following approximation holds:

$$I_{OUT}\approx(\mathrm{I101})^2/(\mathrm{I102})$$

Figure 3:
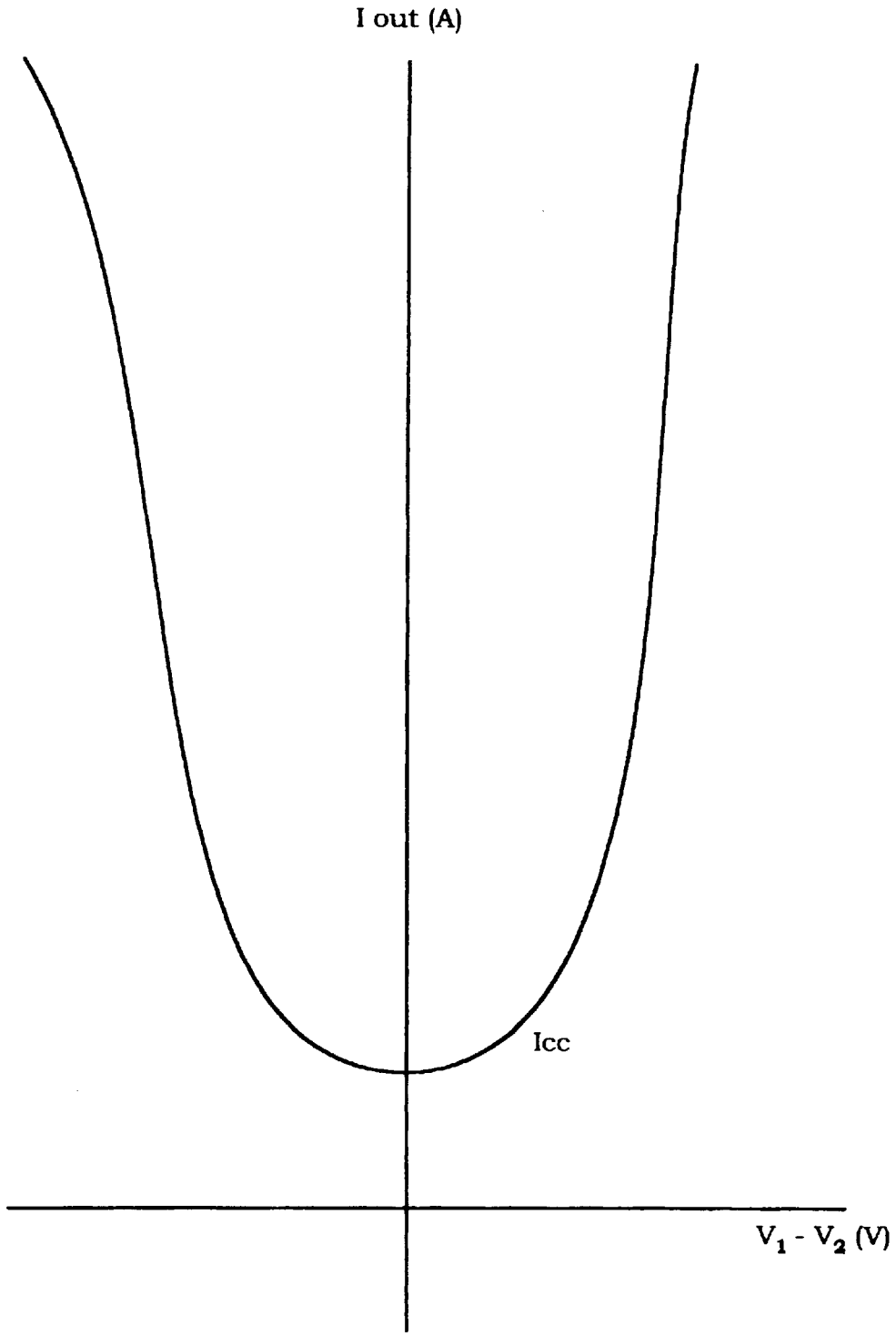
FIG. 3 is a graph showing output current as a function of differential voltage for the circuit of FIG. 2.

FIG. 3 shows the approximate relationship between the differential voltage and the output current $I_{OUT}$. Output current is at a minimum when the two input voltages are identical, and the output current is not less than $I_{CC}$.

The currents flowing into the second power supply 32 which supply $V_{EE}$ may be summed:

$$I_{TOTAL}=2I_{CC}+I_{OUT}=2I_{CC}+I_{CC}(\cos h(3V_d/2V_T))/(\cos h(V_d/2V_T))$$

No standby current is required. The current flowing into the second power supply increases only as $I_{OUT}$ increases, and $I_{OUT}$ increases as the magnitude of the differential voltage $V_d$ increases.

Figure 4:
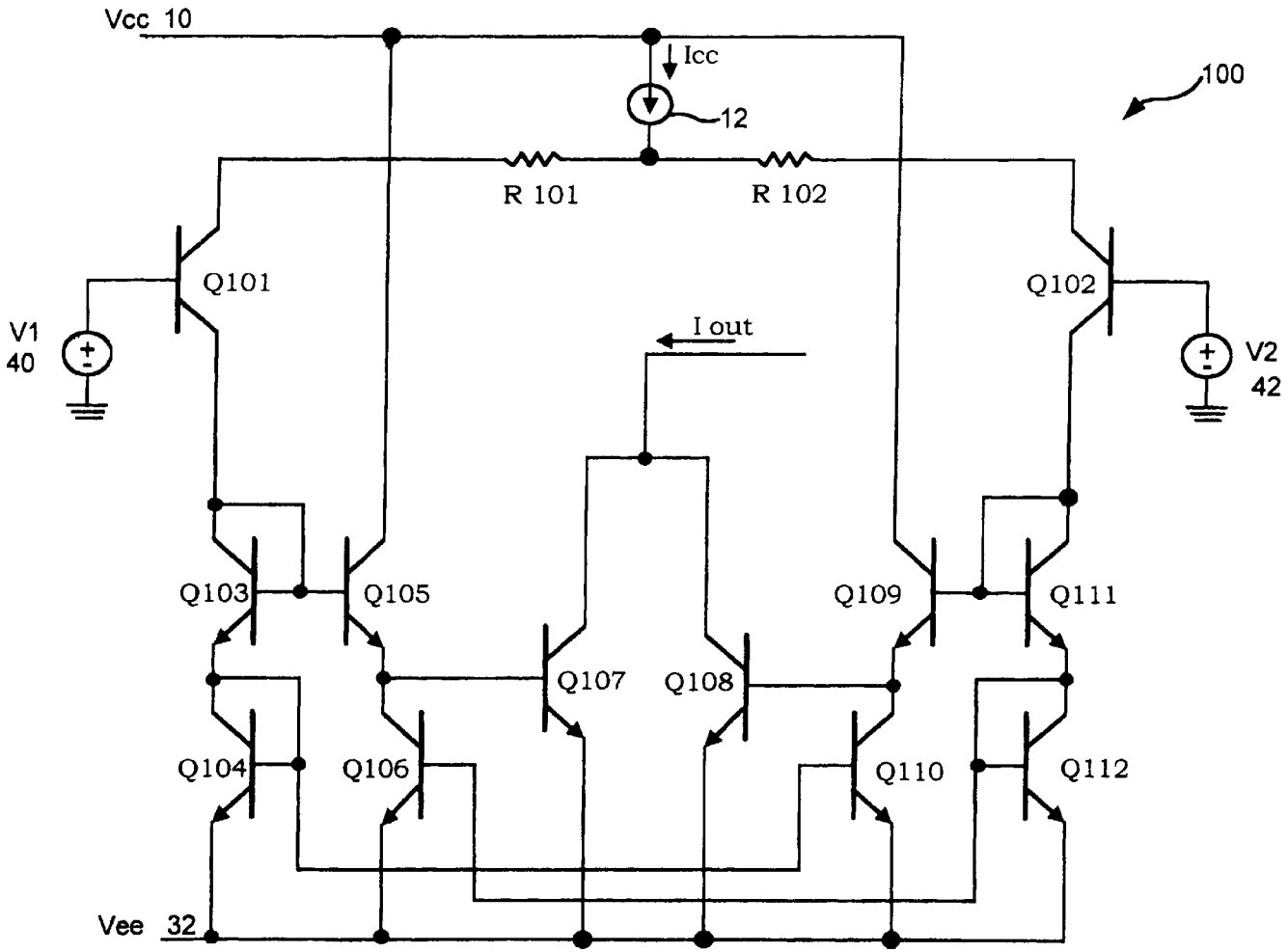
FIG. 4 is a schematic diagram of an electrical circuit for an alternative implementation of a voltage-controlled current source including resistors to provide degeneration.

FIG. 4 shows an alternative implementation of the invention. Resistors R101 and R102 are coupled between the current bias source 12 and the respective emitters of transistors Q101 and Q102, forming an alternative implementation of differential input circuits 14, 15 of FIG. 1. Resistors R101 and R102 provide emitter degeneration of transistors Q101 and Q102, decreasing the gain of the device.

Figure 5:
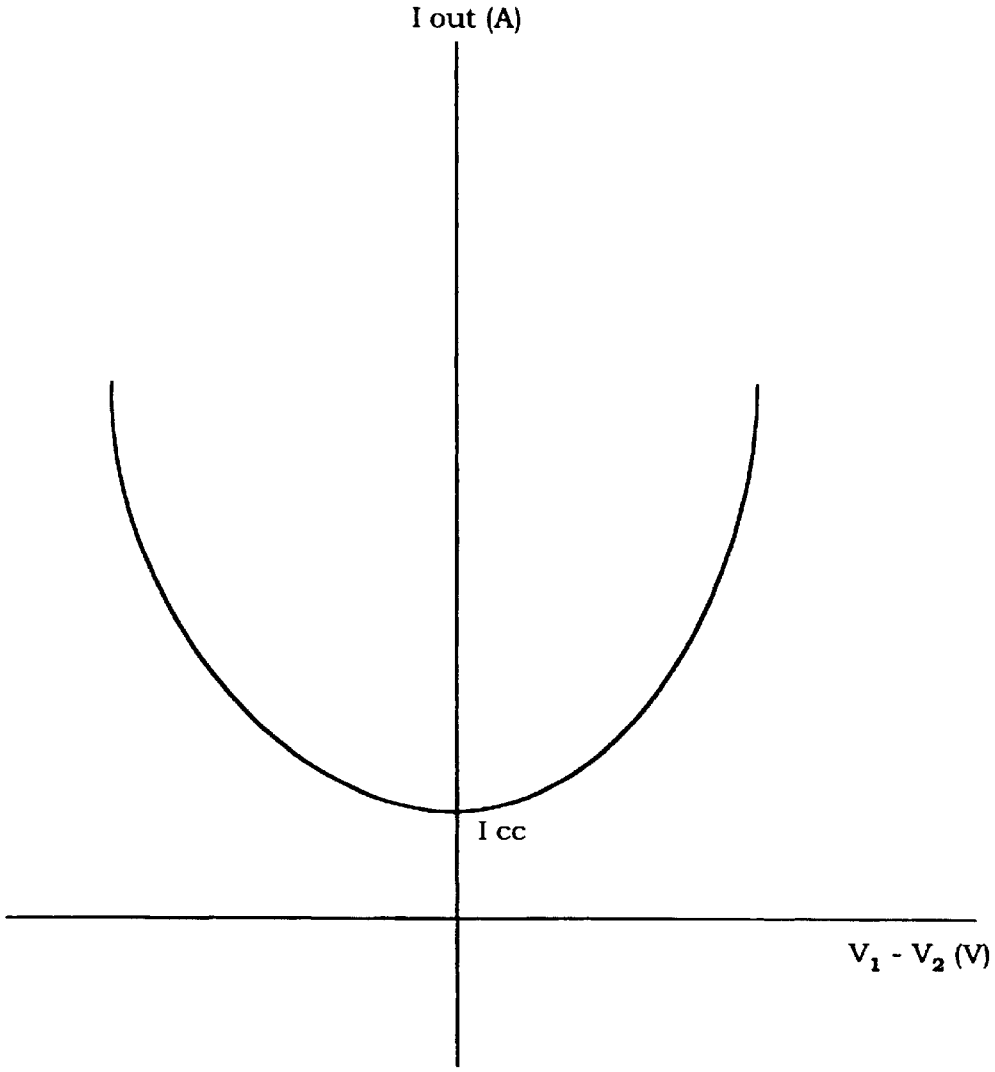
FIG. 5 is a graph showing output current as a function of differential voltage for the circuit of FIG. 4.

FIG. 5 shows the effect upon output current $I_{OUT}$ as a function of input differential voltage for this configuration. As can be readily seen, the steepness of the function that describes the output current has been reduced as the gain is reduced.

Figure 6:
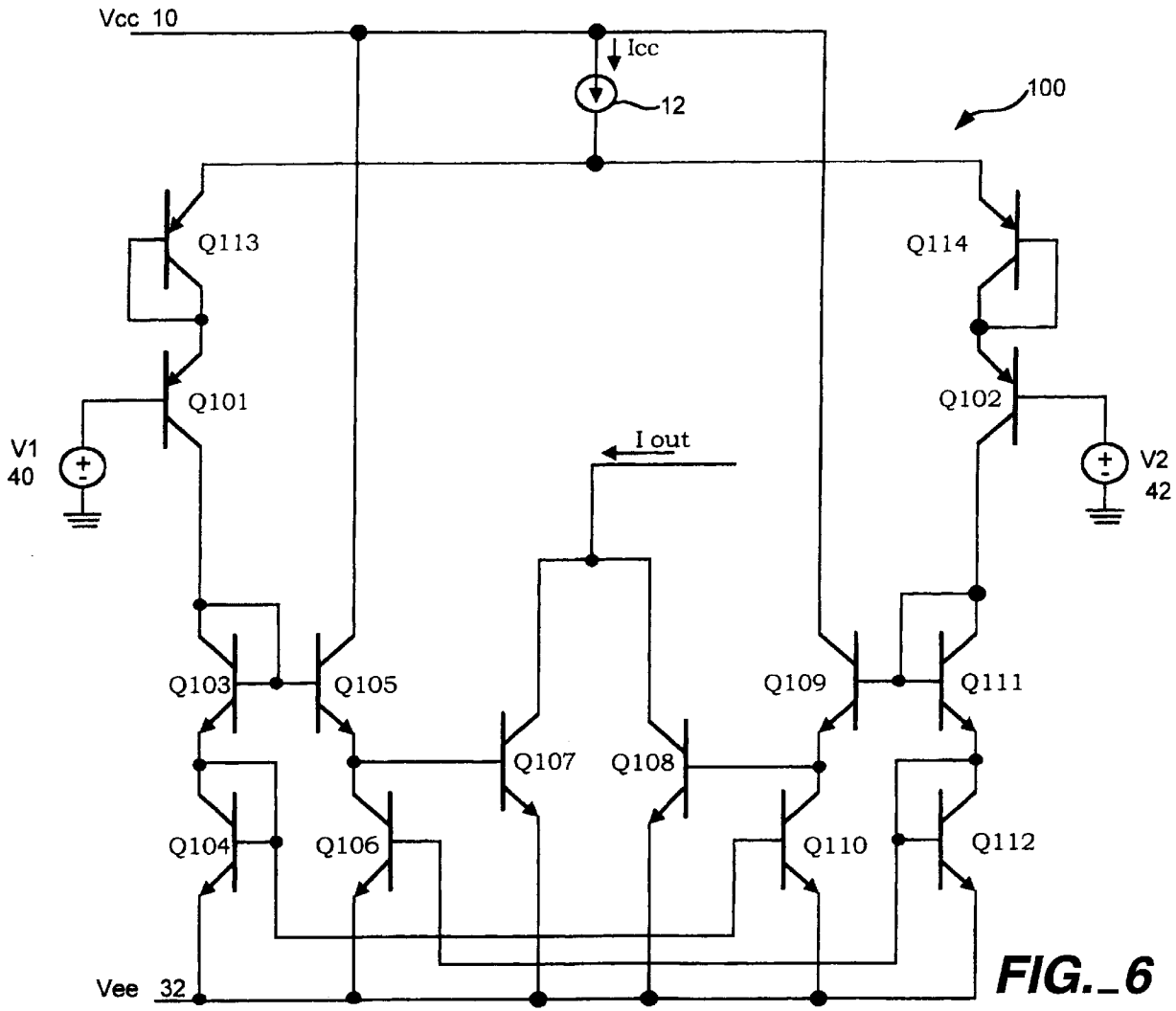
FIG. 6 is a schematic diagram of an electrical circuit for an alternative implementation of a voltage-controlled current source including blocking diodes.

Another implementation of the device appears in FIG. 6. In this implementation, diode-connected transistors Q113 and Q114 have been added between independent biasing current source 12 and transistors Q101 and Q102 (forming a third variation of differential input circuits 14, 15 of FIG. 1). Transistors Q113 and Q114 act as blocking diodes, increasing the maximum differential voltage which may be applied to the inputs, while keeping the remaining transistors in forward active operation mode. Although shown as transistors with the base and collector shorted, actual diodes may be used in their place. The effect of the blocking diodes is to decrease the gain of the device.

Figure 7:
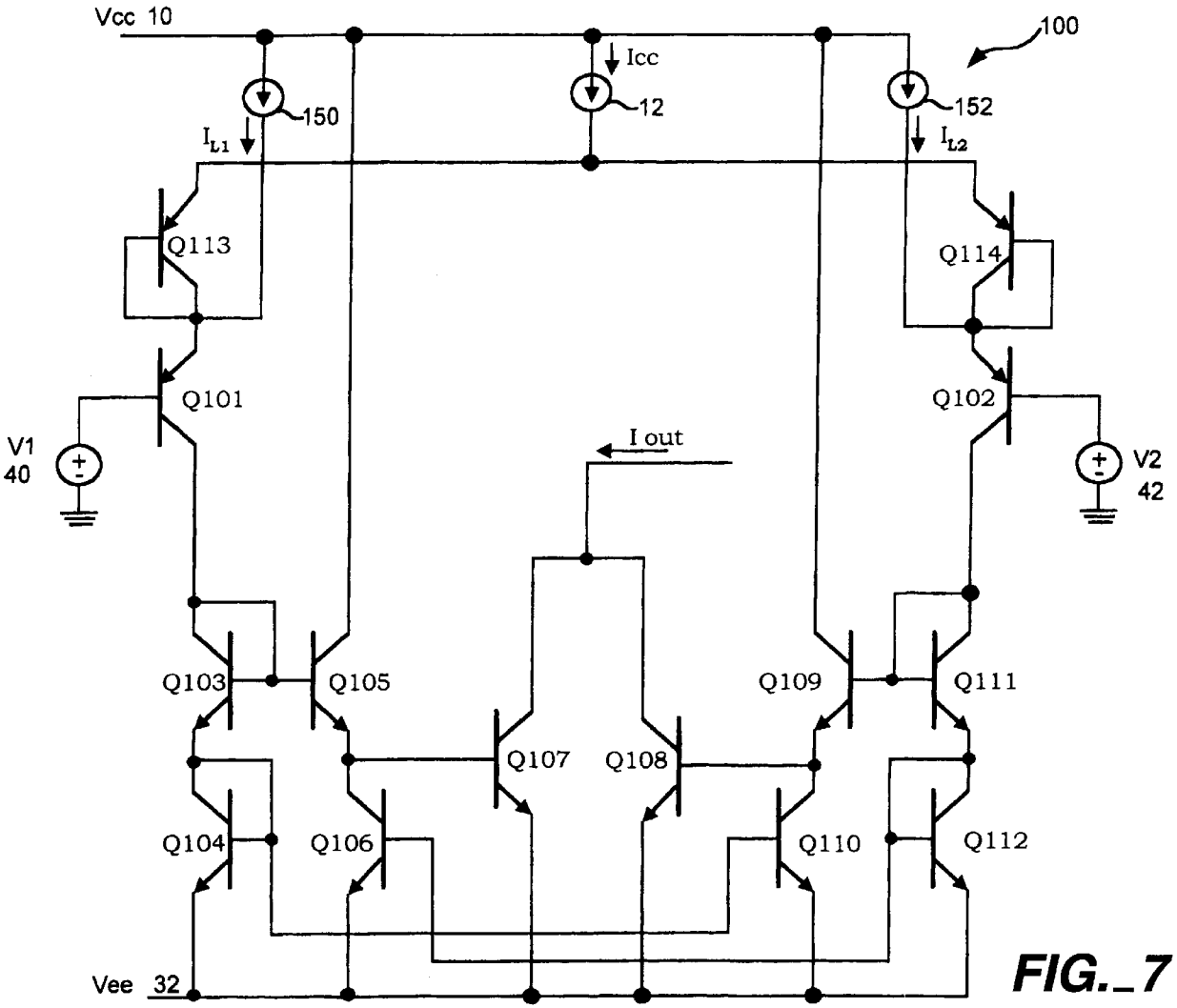
FIG. 7 is a schematic diagram of an electrical circuit for an alternative implementation of a voltage-controlled current source including additional independent current sources and blocking diodes.
Figure 8:
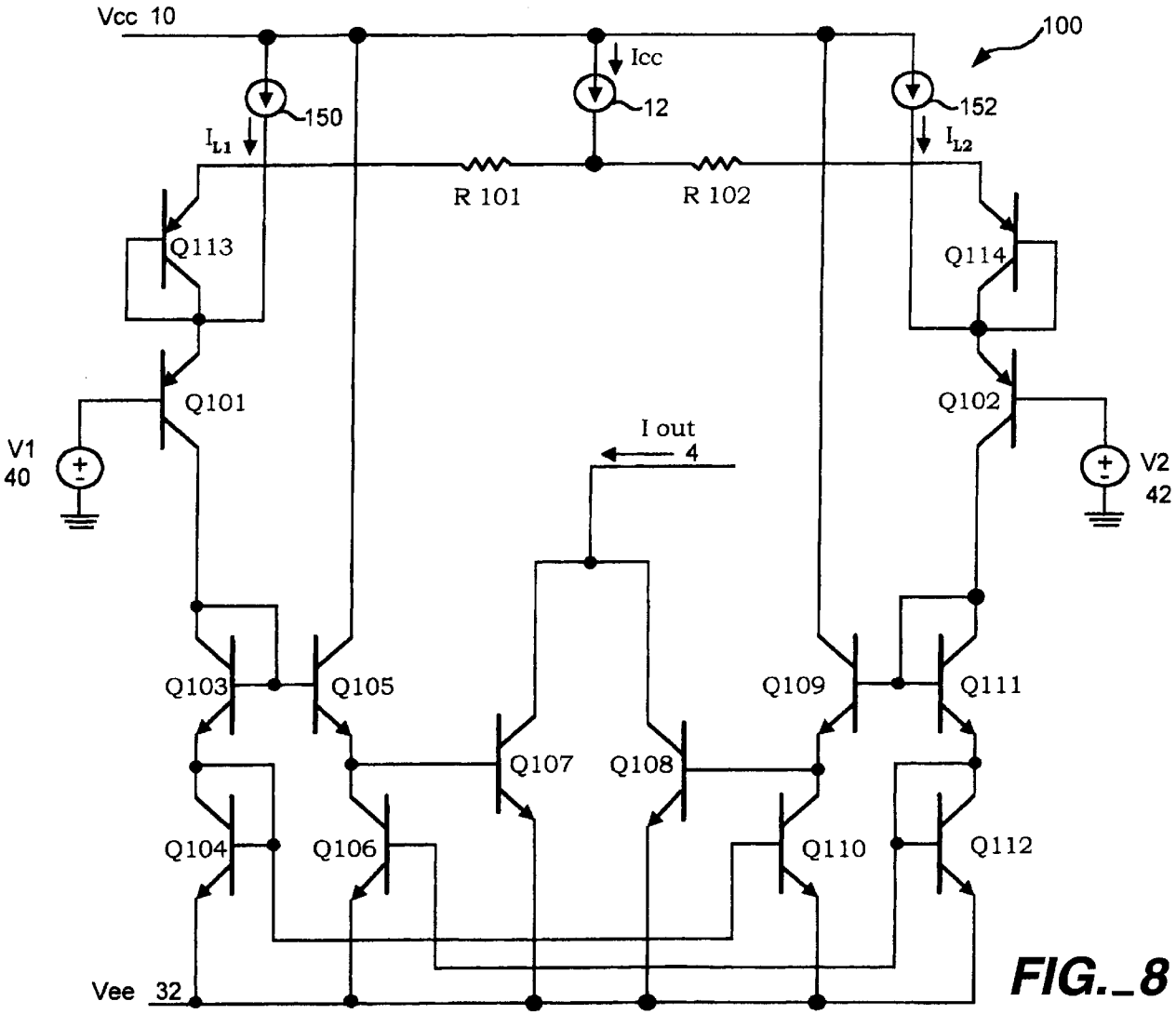
FIG. 8 is a schematic diagram of an electrical circuit for an alternative implementation of a voltage-controlled current source including additional independent current sources, degeneration and blocking diodes.

Another implementation is shown in FIG. 7, which is similar to FIG. 6 except that two additional Independent Current Sources 150 and 152 are included that provide currents $I_{L1}$ and $I_{L2}$ to the emitters of the input transistors Q101 and Q102 (forming a fourth variation to the differential input circuits 14, 15 of FIG. 1). In one implementation, $I_{L1}$ and $I_{L2}$ are equal to each other, but they are not necessarily equal to $I_{CC}$. Independent Current Sources 150 and 152, along with Independent 1. Biasing Current Source 12, serve to place maximum and minimum values on $I_{OUT}$ by setting maximum base voltages on Q107 and Q108. Independent Current Sources 150 and 152 set a minimum current through Q104 and Q112, and consequently set minimum currents through mirror transistors Q110 and Q106. Currents through Q106 and Q110 act to pull down the base voltages of Q107 and Q108, respectively. This pulling down of base voltages prevents the base voltages of Q107 and Q108 from going as high, thereby limiting the base-to-emitter voltages of Q107 and Q108, which in turn limits their collector currents, thereby limiting $I_{OUT}$ Another implementation is shown in FIG. 8, which is similar to FIG. 7 with the addition of emitter-degenerating resistors R101 and R102 between independent biasing current source 12 and the emitters of transistors Q113 and Q114 (forming a fifth variation to the differential input circuits 14, 15 of FIG. 1). Resistors Ri01 and R102 can be used to again reduce the circuit gain. In one implementation, resistors R101 and R102 are sized to be 6.9 kiloohms, current sources 150 and 152 each produce $I_{L1}=I_{L2}$=approximately 6.25 microamps, current source 12 produces $I_{CC}$ approximately 50 microamps, with the first power supply 10 set to $V_{CC}$=+15 volts and the second power supply 32 set to $V_{EE}$=−5 volts.

Figure 9:
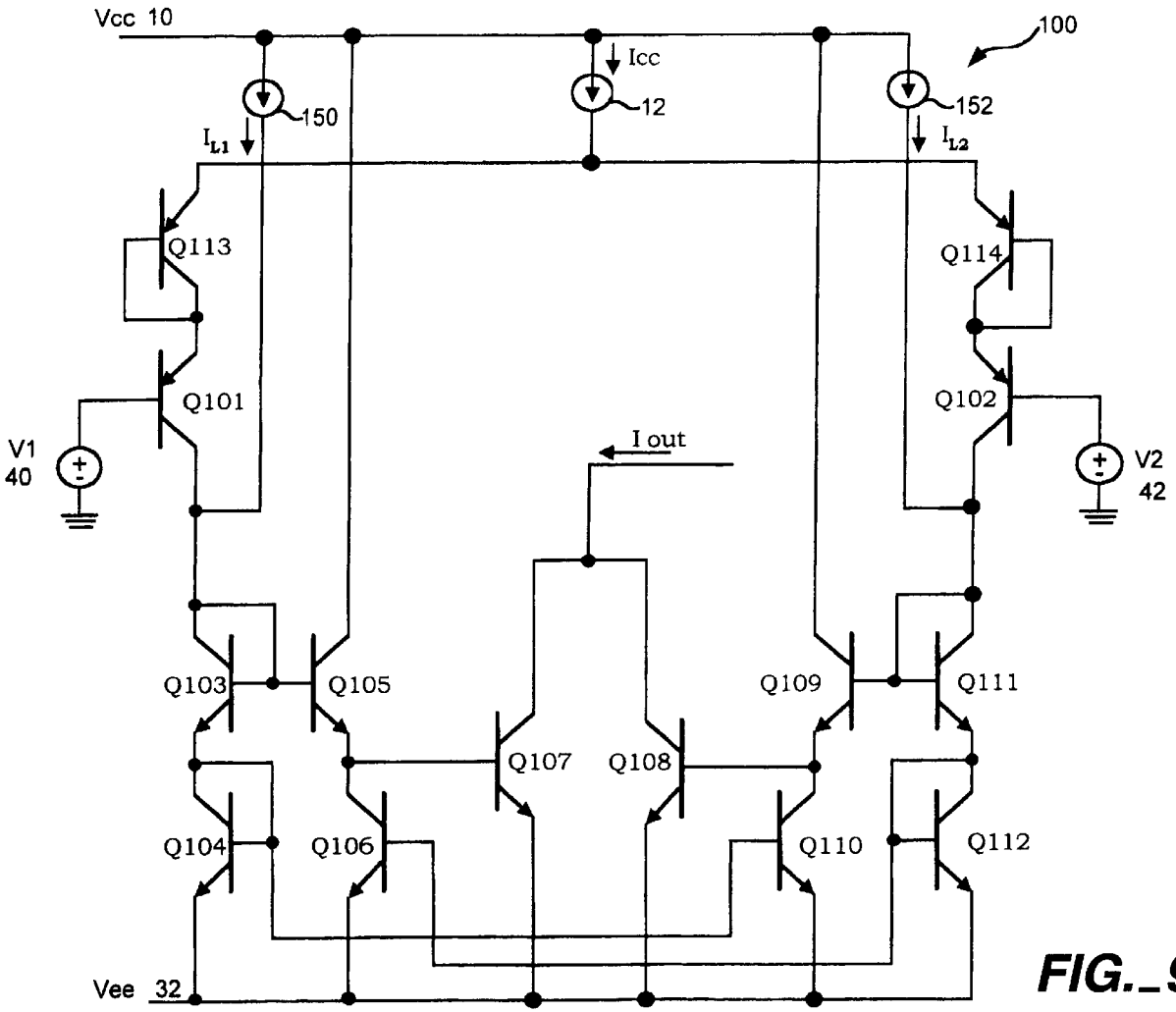
FIG. 9 is schematic diagram of an electrical circuit for an alternative implementation of a voltage-controlled current source including additional independent current sources and blocking diodes.

FIG. 9 shows a further implementation. This circuit is similar to that shown in FIG. 7, except that Independent Current Sources 150 and 152 provide currents $I_{L1}$ and $I_{L2}$ to the collectors of input transistors Q101 and Q102 respectively, rather than to the emitters of the input transistors Q101, Q102 (forming a sixth variation to the differential input circuit 14, 15 of FIG. 1). $I_{L1}$ and $I_{L2}$ may be equal to each other but not equal to $I_{CC}$. If $I_{L1}$ and $I_{L2}$ are equal to each other (their common value being $I_L$), then the minimum output current would be $I_{CC}$ plus $2I_L$, and the maximum current would be $$I_{MAX}=(I_L+I_{CC})^2/I_L+I_L^2/(I_L+I_{CC})$$

The gain of this circuit would also be slightly greater than that of the circuit shown in FIG. 7.

Figure 10:
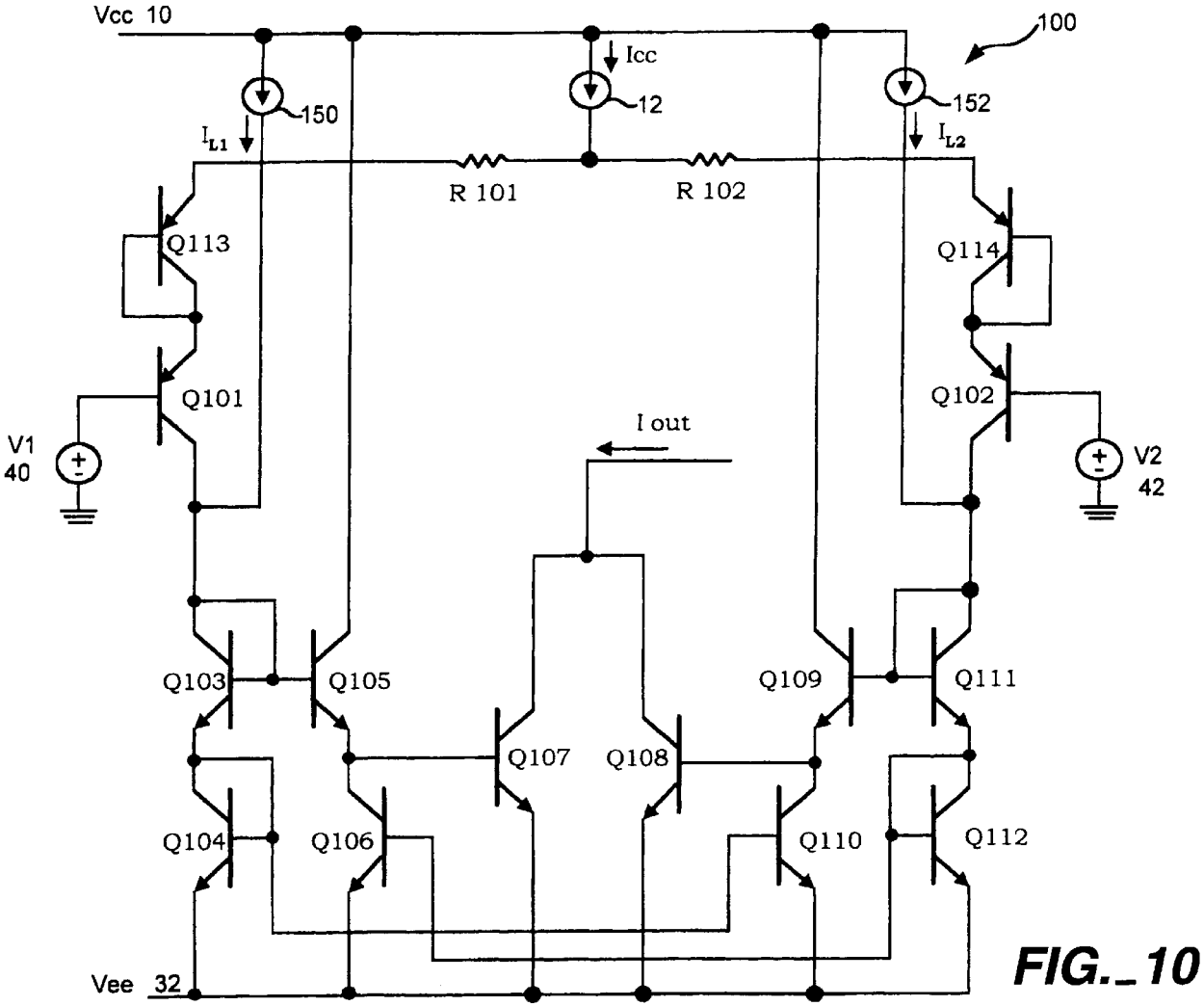
FIG. 10 is schematic diagram of an electrical circuit for an alternative implementation of a voltage-controlled current source including additional independent current sources, degeneration and blocking diodes.

In an additional implementation shown in FIG. 10, the circuit is similar to that shown in FIG. 9, except degeneration resistors R101 and R102 have been added between independent biasing current source 12 and the emitters of transistors Q113 and Q114 (forming a seventh variation to the differential input circuits 14, 15 of FIG. 1). Resistors R101 and R102 can be used to again reduce the circuit gain.

While this invention has been described in terms of several preferred implementations, it is contemplated that alterations, modifications and permutations thereof will become apparent to those skilled in the art upon a reading of the specification and study of the drawings. For example, the invention may be implemented with pnp bipolar junction transistors in place of npn bipolar junction transistors (and vice versa), or the invention may be implemented with field effect transistors. The circuit may be implemented with supply voltages of various positive or negative values, or with a supply voltage tied to a circuit ground. Different biasing currents may be selected. Although the implementations described above are mirror-symmetric, mirror-symmetry is not essential to this invention, and many variations on the output curves shown in FIG. 3 and FIG. 5 are possible. Various transistor geometries and doping concentrations may be used. The materials employed to implement the invention may be any suitable semiconducting materials, such as silicon or gallium arsenide. Additional features can be incorporated to meet particular demands, such as frequency response, common mode rejection, and signal swing. Application of the invention is virtually unlimited, as it may be applied to many circuits requiring current sources, and may be especially useful in circuits which cannot efficiently provide large standby current.

What is claimed:

1. A method for providing electrical output current, comprising:

providing a supply current;

providing a first and second voltage input signal for controlling output current; and generating an output current based on a differential voltage measured between the first and second input voltage signals including increasing the supply current as the output current increases.

2. A device for providing electrical current, comprising:

biasing circuitry providing a biasing current $I_{CC}$;

input circuitry including a first voltage input and a second voltage input, the input circuitry operable to receive the biasing current $I_{CC}$ and to divide the biasing current $I_{CC}$ based on the differential voltage measured between the first and second voltage inputs producing first and second biasing currents; and a pair of translinear circuits operable to receive the first and second biasing currents and responsive thereto produce a first and second output current, the first and second output currents being summed to produce a final output current for the device where the final output current is a minimum of $I_{CC}$ when the differential voltage is approximately zero volts.

3. A device for providing electrical current, comprising:

biasing circuitry providing a biasing current $I_{CC}$;

input circuitry including a first voltage input and a second voltage input, the input circuitry operable to receive the biasing current $I_{CC}$ and to divide the biasing current $I_{CC}$ based on the differential voltage measured between the first and second voltage inputs producing first and second biasing currents; and a pair of non-linear circuits operable to receive the first and second biasing currents and responsive thereto produce a first and second output current, the first and second output currents being summed to produce a final output current for the device where the final output current is a minimum of $I_{CC}$ when the differential voltage is approximately zero volts.

4. The device of claim 2, wherein the translinear circuits are mirror symmetric.

5. The device of claim 2, wherein the translinear circuits share at least two common voltages.

6. The device of claim 2, wherein each translinear circuit comprises current mirroring circuitry that copies a current flowing through the other translinear circuit.

7. The device of claim 2, wherein the translinear circuits are constructed from bipolar junction transistors.

8. The device of claim 6, wherein the transistors are matched for reverse saturation current.

9. The device of claim 2, wherein the translinear circuits are constructed from field effect transistors.

10. The device of claim 2, wherein the input circuitry further comprises circuitry to regulate gain.

11. The device of claim 10, wherein the gain-regulating circuitry comprises degenerating resistors that couple the biasing circuitry to the input circuitry.

12. The device of claim 10, wherein the gain-regulating circuitry comprises blocking diodes that couple the biasing circuitry to the input circuitry.

13. The device of claim 12, wherein the blocking diodes are diode-connected transistors.

14. The device of claim 12, wherein the gain-regulating circuitry further comprises additional biasing circuitry providing additional biasing current being received by the input circuitry, the additional biasing current bypassing the blocking diodes.

15. The device of claim 12, wherein the gain-regulating circuitry further comprises additional biasing circuitry providing additional biasing current, the additional biasing current being received between the input circuitry and the translinear circuits.

16. The method of claim 1, further comprising providing degeneration to adjust the gain.

17. The method of claim 1, further comprising providing blocking diodes to adjust the gain.

18. The method of claim 1, further comprising providing a plurality of supply currents to limit the magnitude of the output current.

19. The method of claim 1, wherein the input differential voltage and the output current are related by a ratio of approximately hyperbolic cosine functions.

20. The method of claim 1, wherein a first current is based upon voltage measured at the first voltage input, and a second current is based upon voltage measured at the second voltage input, and the output current $I_{OUT}$ is approximately equal to the square of the first current divided by the second current.

21. The method of claim 1, wherein the output current is a function of the absolute value of the differential voltage.

22. A device for providing electrical current powered by a power supply, comprising:

biasing circuitry providing a biasing current $I_{CC}$;

a first half differential transconductance circuit coupled to the biasing circuitry, including a terminal to receive a first input voltage and conducting a current I101, the current I101 depending upon the differential between the first input voltage and a second input voltage;

a second half differential transconductance circuit coupled to the biasing circuitry, including a terminal to receive the second input voltage and conducting a current I102, the current I102 depending upon the differential between the first input voltage and the second input voltage;

a first translinear circuit coupled to the first half differential transconductance circuit that receives current I101 and a copy of current 1102, and produces an output current I103 dependent upon the differential between current I101 and current I102;

a second translinear circuit that receives current 1102 and a copy of current I101, and produces an output current I104 dependent upon the differential between current I102 and current I101; and wherein output current I103 and output current 1104 combine to produce a final output current.

23. The device of claim 22, wherein the first half differential transconductance circuit and the second half differential transconductance circuit comprise a pair of half differential transconductance circuits, each half differential transconductance circuit comprising:

a pnp bipolar junction transistor, the base of the transistor receiving one of the first or second input voltages, the emitter of the transistor receiving a divided portion of the biasing current $I_{CC}$ and the collector of the transistor coupled to the first translinear circuit.

24. The device of claim 22, wherein the first translinear circuit and the second translinear circuit comprise a pair of translinear circuits, each translinear circuit coupled to one half differential transconductance circuit and each translinear circuit comprising:

a first diode-connected npn bipolar junction transistor that receives a current at the first transistor's collector directly from the half differential transconductance circuit and conducts the current through the first transistor's emitter;

a second diode-connected npn bipolar junction transistor that receives at the second transistor's collector the current from the emitter of the first transistor and conducts the current through the second transistor's emitter to a reference node, the second transistor serving as the reference side of a current mirror that copies the current flowing through the second transistor to the other translinear circuit;

a third npn bipolar junction transistor, the third transistor's collector coupled to the power supply and the third transistor's base coupled to the first transistor's base;

a fourth npn bipolar junction transistor, the fourth transistor's collector coupled to the third transistor's emitter, the fourth transistor's emitter coupled to the reference node and the fourth transistor's base coupled to base of the second transistor in the other translinear circuit, the second transistor in the other translinear circuit serving as the reference side and the fourth transistor serving as the mirror side of a current mirror that copies a current flowing through the second transistor in the other translinear circuit; and a fifth npn bipolar junction transistor, the fifth transistor's base coupled to the collector of the fourth transistor, the fifth transistor's emitter coupled to the reference node, and the fifth transistor's collector coupled to the collector of the fifth transistor of the other translinear circuit.

25. The device of claim 24 wherein the first transistor, the second transistor, the third transistor, the fourth transistor and the fifth transistor of one translinear circuit are not matched for reverse saturation current with the first transistor, the second transistor, the third transistor, the fourth transistor and the fifth transistor of the other translinear circuit.

26. The device of claim 24 wherein the power supply is a first power supply and wherein the reference node is coupled to a second power supply.

27. The device of claim 22 further comprising a first resistor interposed between the first half differential transconductance circuit and the biasing circuitry, and a second resistor interposed between the second half differential transconductance circuit and the biasing circuitry.

28. The device of claim 22 further comprising a first blocking diode with a cathode coupled to the first half differential transconductance circuit and an anode coupled to the biasing circuitry, and a second blocking diode with a cathode coupled to the second half differential transconductance circuit and an anode coupled to the biasing circuitry.

29. The device of claim 28, wherein the first blocking diode and the second blocking diode each comprises a diode-connected pnp bipolar junction transistor.

30. The device of claim 28 further comprising a first additional biasing current source and a second additional biasing current source, the first additional biasing current source supplying current to the node connecting the first blocking diode to the first half differential transconductance circuit, and the second additional biasing current source supplying current to the node connecting the second blocking diode to the second half differential transconductance circuit.

31. The device of claim 28 further comprising a first additional biasing current source and a second additional biasing current source, the first additional biasing current source supplying current to the node connecting the first translinear circuit to the first half differential transconductance circuit, and the second additional biasing current source supplying current to the node connecting the second translinear circuit to the second half differential transconductance circuit.

* * * * *